US007131373B2

(12) United States Patent
Edson

(10) Patent No.: US 7,131,373 B2
(45) **Date of Patent: *Nov. 7, 2006**

(54) SCREEN PRINTING REPETITION SYSTEMS AND METHODS

(76) Inventor: Michael S. Edson, 4200 NW. Cinnamon Ct., Blue Springs, MO (US) 64015

( * ) Notice: Subject to any disclaimer, the term of this patent is extended or adjusted under 35 U.S.C. 154(b) by 0 days.

This patent is subject to a terminal disclaimer.

(21) Appl. No.: 11/224,629

(22) Filed: Sep. 12, 2005

(65) Prior Publication Data

US 2006/0005720 A1 Jan. 12, 2006

Related U.S. Application Data

(62) Division of application No. 10/763,983, filed on Jan. 23, 2004, now Pat. No. 7,013,801.

(60) Provisional application No. 60/442,408, filed on Jan. 24, 2003.

(51) Int. Cl.
*B41F 1/07* (2006.01)
*B41L 13/18* (2006.01)
*B05C 17/06* (2006.01)

(52) U.S. Cl. ..... 101/123; 101/114; 101/126; 101/127; 101/127.1; 101/128; 101/128.4

(58) Field of Classification Search ..... 101/123, 101/127.1, 114, 126, 127, 128, 128.4
See application file for complete search history.

(56) References Cited

U.S. PATENT DOCUMENTS 3,943,849 A 3/1976 Vasilantone
4,648,317 A 3/1987 Bubley et al.
4,974,507 A 12/1990 Eppinger
5,315,929 A 5/1994 Sundqvist
5,626,074 A 5/1997 Zelko
5,771,801 A 6/1998 Newman et al.
5,953,987 A 9/1999 Oleson
5,996,486 A 12/1999 Karlyn et al.

FOREIGN PATENT DOCUMENTS

| | | |
|---|---|---|
| DE | 878492 | 7/1949 |
| GB | 618356 | 2/1949 |
| GB | 688194 | 3/1953 |
| GB | 776636 | 6/1957 |

OTHER PUBLICATIONS

M&R Printing Equipment, Inc., M&R Chameleon Operators Manual, 1999.

*Primary Examiner*—Ren Yan
*Assistant Examiner*—Marvin P. Crenshaw
(74) *Attorney, Agent, or Firm*—Lathrop & Gage LC

(57) ABSTRACT

A screen printing manual repetition system semi-automates use of a screen with a manual printing press. The screen has a screen frame and a screen mesh. The manual repetition system (MRS) has an MRS frame mountable to the screen frame, a track system, and a height adjustor configured to adjust the height of the track system relative to the MRS frame. A squeegee has a squeegee frame with a blade, guide members configured to guide the squeegee through the track system, and an angle adjustor configured to adjust the angle of the blade relative to the screen mesh during operation.

68 Claims, 12 Drawing Sheets

SCREEN PRINTING REPETITION SYSTEMS AND METHODS

RELATED APPLICATIONS

The present application is a divisional application of U.S. Pat. application Ser. No. 10/763,983, filed Jan. 23, 2004, now U.S. Pat. No. 7,013,801 which claims benefit of priority to U.S. patent application Ser. No. 60/442,408, filed Jan. 24, 2003, each of which are incorporated herein by reference.

BACKGROUND OF THE INVENTION

Screen printing is a process for applying an ink or other substances to a variety of substrates. A printing press is used to apply the ink to the substrate in a process referred to as registration.

A screen is placed in the printing press. The screen has a screen frame with a screen mesh. Ink is forced through the screen and onto the printing surface of the substrate. Multiple colors of ink may be applied separately. Typically, the ink is applied, either manually or by an automated machine, with a squeegee that puts pressure against the screen mesh to keep the screen mesh in contact with the underlying substrate.

FIG. 1 depicts an example of a manual printing press 102. The printing press 102 has a frame 104 to which a center shaft 106 is attached. A pallet carousel 108 and a screen frame carousel 110 may be independently rotated about the center shaft 106 either clockwise or counterclockwise.

The pallet carousel 108 includes one or more pallet support arms 114 extending from the central portion 112 of the pallet carousel 108. At the end of each pallet support arm 114 is a pallet 116. A substrate 118, such as a shirt, other textile, or other substrate, is placed on, over, or around the pallet 116 so that ink or another substance may be applied to the substrate.

The screen frame carousel 110 includes one or more print head assemblies 120 extending from the central portion 122 of the screen frame carousel. Each print head assembly 120 has a hinge 124 connecting one or more screen frame clamps 126 to the central portion 122 of the screen frame carousel 110.

A screen 128 having a screen frame 130 and a screen mesh 132 fits at or in the screen frame clamp 126. Although the clamps 126 are depicted as clamping on the sides of the screen frame 130, other clamping systems may be used, such as front clamps and/or rear clamps.

One or more clamp adjusters 134 are used to tighten the screen 128 within the screen frame clamp 126, and one or more print controls 136 adjust the alignment of the clamped screen 128 within the screen frame clamp 126. In one example, one or more controls 136 are used to adjust the screen 128 in the X axis and Y axis relative to the print head assembly 120 so that ink may be applied onto the substrate 118 at precise points on the substrate.

A squeegee 138 is used to pull ink or another fluid or substrate across the screen mesh 132. Typically, the squeegee 138 has a frame 140 and a blade 142.

In operation, a user places a screen 128 in a print head assembly 120 and adjusts the clamp adjusters 134 so that the screen fits tightly within the screen frame clamps 126. The user places a garment, cloth, or other substrate 118 on a pallet 116. The user may rotate the print head assembly 120 with the screen 128 and/or the pallet 116 having the substrate 118 so that the screen and print head assembly are properly located above the substrate. The user then lowers the print head assembly 120 with the screen 128 so that the screen mesh 132 is in contact with, or directly above, the substrate 118. Ink (not shown) or another fluid is placed on the screen mesh 132. A squeegee 138 then is used to pull the ink across the screen mesh 132 and onto the substrate 118. The user must apply at least some downward pressure on the squeegee 138 while pulling the squeegee across the screen mesh 132 in order to force the ink through the screen mesh. The user generally applies pressure to the squeegee at an angle so that the blade of the squeegee forces the ink through the screen mesh 132. The downward angled pressure causes the screen mesh 132 to contact the substrate 118 while forcing the ink through the screen mesh, thereby applying the ink onto the substrate.

In the above example, the user has to judge how much pressure is to be applied with the squeegee 138 and the angle at which the blade 142 is to be applied to the screen mesh 132 each time the user pulls the squeegee over the screen mesh. The amount of pressure and the angle applied by the user to the squeegee 138 and therefore to the screen mesh 132 may therefore be different each time the user pulls the squeegee across the screen mesh.

As the user continuously pulls the squeegee 138 across the screen mesh 132, either because multiple colors are to be applied onto the substrate 118 and/or because a design is to be applied to multiple substrates, the user tends to tire. Therefore, the user tends to misjudge the actual pressure and angle being applied to the squeegee 138 and therefore to the screen mesh 132.

Additionally, since the width of the blade 142 of the squeegee 138 is less than the width of the screen mesh 132, the user must attempt to maintain the blade in a substantially horizontal plane as the user pulls the squeegee across the screen mesh. However, users to tend to pull the squeegee at an angle in the horizontal plane such that either the left or right side of the blade 142 is pulled across the screen mesh 132 before the other side. This causes ink to be applied onto the substrate 118 in an uneven manner. This uneven registration typically is exacerbated when the user tires or otherwise when multiple pulls are required.

Moreover, a variance in the vertical pressure and angle and the horizontal angle typically occurs when different users operate the press. Other variances also occur when one or multiple colors of ink are applied for a design on a single substrate or multiple substrate. Variances in the registration of colors for a substrate may result in one color running into or over another color of the same design.

Further, the printing industry typically describes the type of pressure to be applied to a squeegee 138 as a "medium" pressure or similar description and at a 57 degree or 60 degree angle. It is difficult for a user to judge whether such a pressure is a "medium" pressure and if the pressure is applied at the specific 60 degree angle or other angle.

Fully automatic presses have been developed to solve some of the above-referenced issues. However, the automatic presses typically are significantly more expensive than a manual press, require more maintenance than a manual press, and require more expensive maintenance than a manual press. Therefore, many users continue using the manual presses instead of purchasing and using the fully automated presses. Often, smaller businesses use manual presses or any business having a smaller number of shirts or other substrates to be applied in a run use manual presses. The manual press industry and the fully automated industry have developed along different paths, and technology associated with the fully automated presses typically does not apply to the technology associated with the manual presses.

Therefore, systems and methods are desirable that enable a user to semi-automate the manual press and the manual press process. Systems and methods are needed to enable a user to apply a squeegee to a screen mesh at consistent horizontal and vertical angles and using a consistent pressure for each registration so that variances in registrations are decreased.

SUMMARY OF THE INVENTION

A screen printing manual repetition system semi-automates use of a screen with a manual printing press. The screen has a screen frame and a screen mesh. In one embodiment, the manual repetition system has an MRS frame mountable to the screen frame, a track system, and a height adjustor configured to adjust the height of the track system relative to the MRS frame. In another embodiment, a squeegee has a squeegee frame with a blade, guide members configured to guide the squeegee through the track system associated with the MRS frame, and an angle adjustor configured to adjust the angle of the blade relative to the guide members and, therefore, relative to the screen mesh.

BRIEF DESCRIPTION OF THE DRAWINGS

FIG. 6 is a perspective view of an adjustment assembly in accordance with an embodiment of the present invention.

FIG. 9 is an inside view of an adjustment assembly and a track system having a receiving end at a first height in accordance with an embodiment of the present invention.

DETAILED DESCRIPTION

Figure 1:
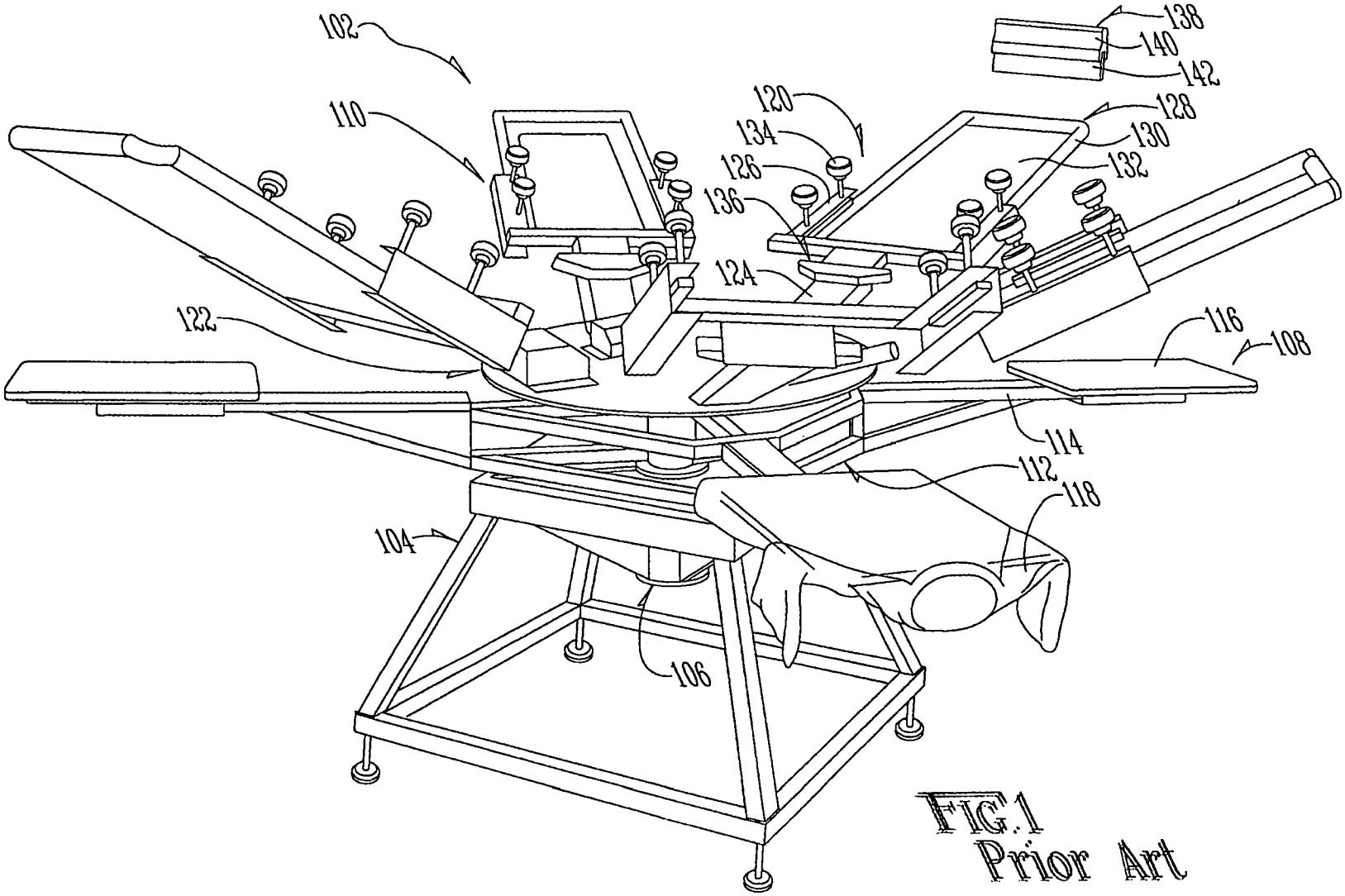
FIG. 1 Prior Art
FIG. 1 is a perspective view of a printing press.
Figure 2:
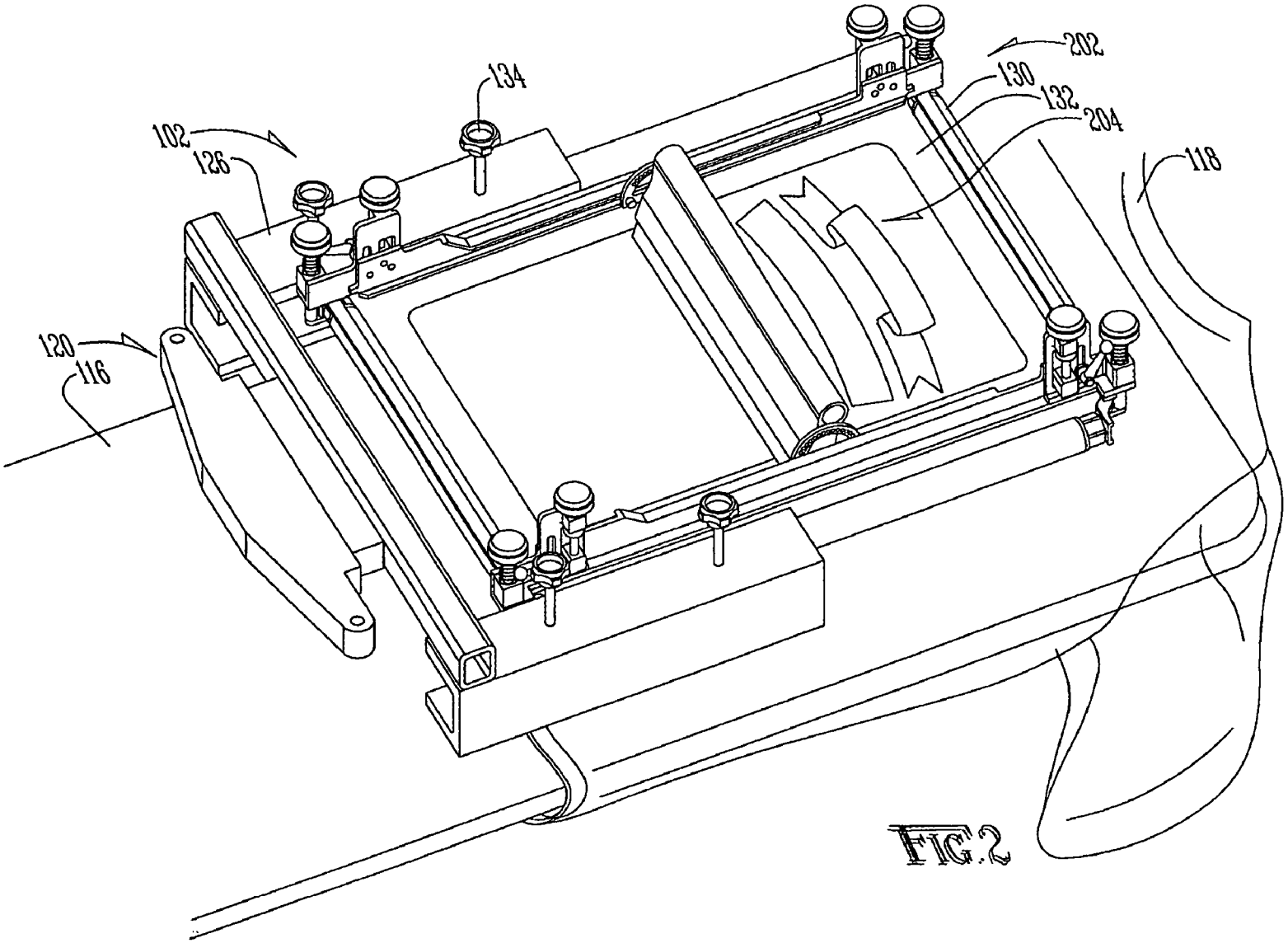
FIG. 2 is a perspective view of a manual repetition system mounted to a print head assembly of a printing press for application of a design on a substrate that is placed on a pallet of the printing press in accordance with an embodiment of the present invention.

FIG. 2 depicts an exemplary embodiment of a manual repetition system 202 of the present invention. The manual repetition system (MRS) 202 enables a user to transfer a consistent amount of pressure to a squeegee and therefore to a screen mesh at consistent horizontal and vertical angles through each registration of ink or another fluid onto a substrate. The consistency is maintained regardless of whether one or more colors of ink or other types of fluid are applied to the substrate, whether one or multiple substrates exist in a run, or whether one or more users apply the ink or other fluid to the substrates in the run.

In the embodiment of FIG. 2, the MRS 202 is mounted to the screen frame 130 of the screen 128. The screen frame 130 then is mounted in the screen frame clamp 126 of the print head assembly 120 of the printing press 102.

A substrate 118 is loaded onto the pallet 116, and the print head assembly 120 with the MRS 202 and the screen 128 is lowered into position. The MRS 202 is used to apply ink or another fluid to the substrate 118, such as with a selected design 204 on the screen mesh 132.

In one embodiment, the MRS 202 is separate from the screen 128. In these embodiments, the manual press 102 may be retrofitted with the MRS 202 and the separate screens 128 so that the manual printing press becomes semi-automated.

In other embodiments, the MRS 202 and the screen frame 130 are a single unit. In these instances, the screen frame 130 is integrated with, and or manufactured as part of, the MRS 202.

Figure 3:
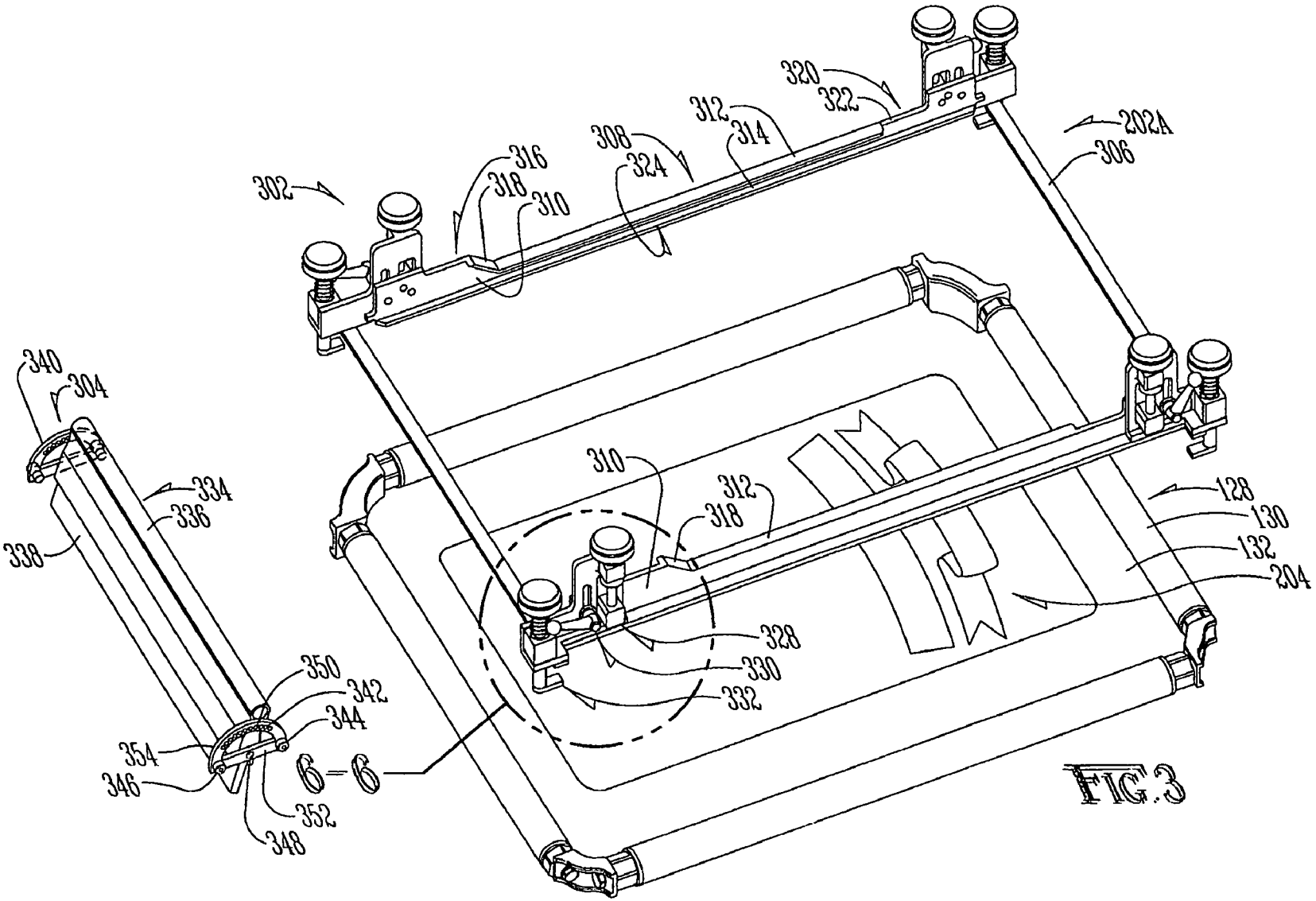
FIG. 3 is an exploded view of a manual repetition system, including a squeegee, and a screen in accordance with an embodiment of the present invention.
Figure 4:
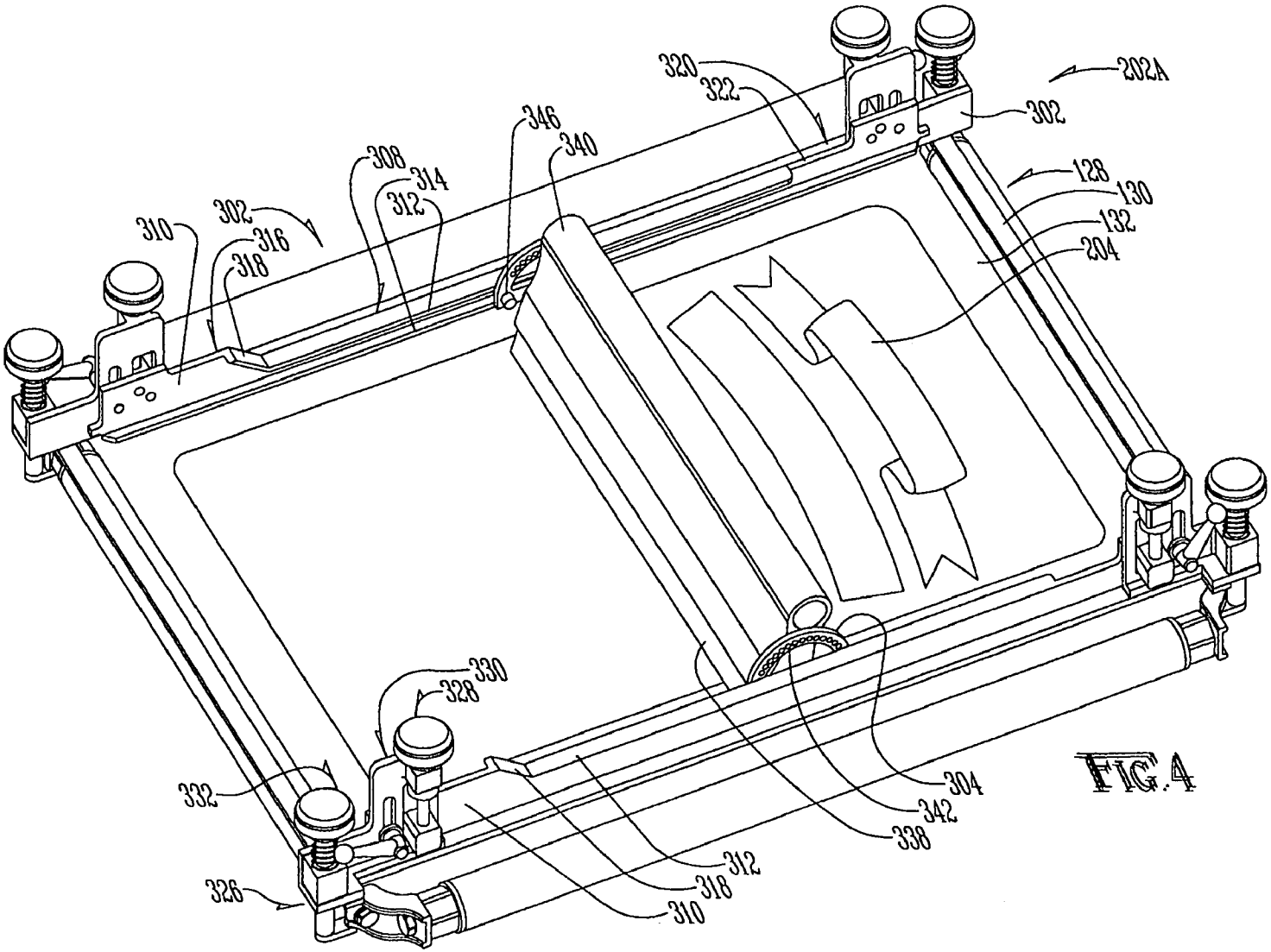
FIG. 4 is a perspective view of a manual repetition system, including a squeegee, mounted on a screen in accordance with an embodiment of the present invention.
Figure 5:
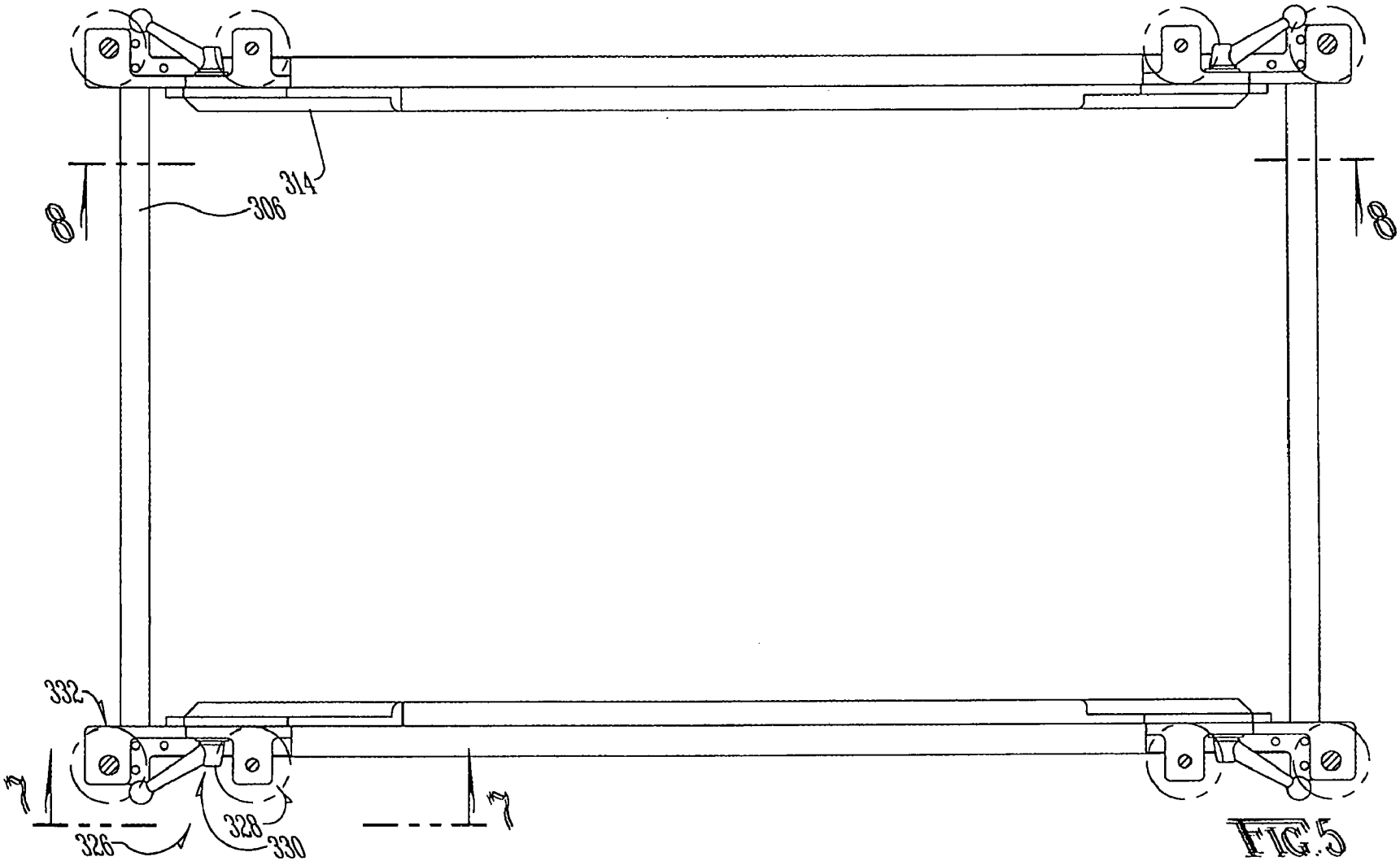
FIG. 5 is a bottom view of a manual repetition system in accordance with an embodiment of the present invention.

FIGS. 3–4 depict an exemplary embodiment of an MRS 202A mounted to a screen 128. FIG. 5 depicts an exemplary embodiment of the MRS 202A without the screen 128.

Referring to FIGS. 3–5, the MRS 202A includes a frame system 302 and an MRS squeegee 304. In one embodiment, the frame system 302 is separate from the screen frame 130. In this instance, the frame system 302 is mounted to the screen frame 130. In another embodiment, the frame system 302 is integrated with the screen frame 130. In this instance, a mounting system is not required. In either instance, the MRS squeegee 304 is operable with the frame system 302. As used herein in connection with the frame system and/or the MRS frame (below) and the screen frame, "mountable" means mounted on and/or formed and/or integrated with the screen frame.

The frame system 302 includes an MRS frame 306 having a front, back, and left and right sides. The MRS frame 306 may be pre-formed as a composite or pre-formed part, or the various sides may be formed separately and mounted together using fasteners, including welds, or otherwise attached. Other examples exist. The MRS frame 306 may be referred to as an adjustment assembly frame, an adjustment system frame, or a registration frame herein.

The track system 308 includes a track frame 310 on each of the left and right sides of the MRS frame 306. Each track frame 310 includes an upper track 312 and a lower track 314. The track frame 310, the upper track 312, and the lower track 314 may be formed separately and mounted together using fasteners, including welds, or formed as a composite or preformed part. Other examples exist.

In one embodiment, a cross member is not formed across the track frame 310 on each side of the track system 308, as depicted in FIG. 3. In another embodiment, a cross member is formed across the track frames at the front and/or back of the track frames to provide additional rigidity (not shown).

In one embodiment, the track system 308 has a receiving end 316 with a flanged area 318 on the upper track 312, an exiting end 320 with a recessed area 322 on the upper track, and an application area 324 between the receiving end 316 and the exiting end 320. In other embodiments, the track system 308 does not include the flanged area 318 of the upper track 312. In still other embodiments, the track system 308 does not include the recessed area 322 of the upper track 312.

The frame system 302 further includes an adjustment assembly 326. In one embodiment, the adjustment assembly 326 includes a height adjuster 328. The height adjuster 328 adjusts the height of the track system 308 relative to the MRS frame 306. In one embodiment, one portion of the height adjuster 328 is mounted to, attached to, or formed as a composite part of, the MRS frame 306. Another portion of the height adjuster 328 is mounted to, attached to, or formed as a composite part of, the track frame 310. A third portion of the height adjuster 328 adjusts the height of the track system 308 relative to the MRS frame 306.

In another embodiment, the adjustment assembly 326 includes a height locking mechanism 330 configured to fix the height of the track system 308 relative to the MRS frame 306 once the appropriate height is selected. In another embodiment, the height locking mechanism 330 is integrated with the height adjuster 328.

In another embodiment, the adjustment assembly 326 includes a mounting system 332 configured to mount the frame system 302 to the screen frame 130. In some embodiments, the mounting system 332 is optional. In other embodiments, the frame system 302 is integrated with the screen frame 130. In these embodiments, the mounting system 332 is not required.

The MRS 202A may include one or more adjustment assemblies. In the embodiments depicted in FIGS. 3–5, four adjustment assemblies are depicted. However, other embodiments may include one, two, six, or another number of adjustment assemblies.

Further, in the embodiments of FIGS. 3–5, the adjustment assemblies are located in the corners of the frame system 302. In other embodiments, one or more adjustment assemblies may be located at the front, the back, the left side, the right side, and/or another location.

The MRS squeegee 304 includes a squeegee frame 334 with a handle 336. The MRS squeegee 304 also includes a blade 338 and at least one angle adjuster 340. In one embodiment, the squeegee 304 has an angle adjuster 340 on each side of the squeegee.

The angle adjuster 340 includes one or more angle selector apertures 342, one of which may be selected to set the angle of the blade 338 relative to the track system 308. The angle selector apertures 342 may be set at specific angles, evenly spaced along a portion of the angle adjustor 340, or otherwise located.

The squeegee 304 also has a first guide member 344 and a second guide member 346 that guide the MRS squeegee 304 through the upper and lower tracks 312 and 314. In one embodiment, the guide members 344 and 346 are located on the angle adjustor 340. In one embodiment, the guide members 344 and 346 are rollers configured to roll between the upper track 312 and the lower track 314. In another embodiment, the guide members 344 and 346 are one or more bearings configured to travel in a groove, such as between the upper track 312 and the lower track 314

The flanged area 318 guides the guide members 344 and 346 between the upper and lower tracks 312 and 314. The recessed area 322 enables the guide members 344 and 346 to upwardly exit the track system 308 with gradual biasing force, one at a time.

In another embodiment, the squeegee 304 may include only a single guide member on each of the left and right sides of the squeegee. A single guide member on each side of the squeegee 304 will maintain the squeegee in the same plane of travel, such as at the same horizontal level relative to the screen 124, as the single guide members are guided through the track system 308. In this example, the flanged area 318 guides the single guide members on each side of the squeegee between the upper and lower tracks 312 and 314.

A fastener 348 fastens the angle adjuster 340 to the squeegee frame 334. An angle locking mechanism 350, such as a pin, locks the squeegee frame 334 within an angle selector aperture 342, thereby locking the squeegee frame and blade 338 at an angle relative to a plane 352 traveled by the first and second guide members 334 and 346 through the track system 308.

Referring now to FIG. 4, the MRS 202A operates as follows in one embodiment. The MRS frame 306 of the frame system 302 is mounted to the screen frame 130 using the mounting system 332. The height adjuster 328 adjusts the height of the track system 308 relative to the MRS frame 306. Since the MRS frame 306 is mounted to the screen frame 130, and the screen mesh 132 is attached to the screen frame, the height adjuster 328 adjusts the height of the track system 308 relative to the screen mesh 132. In this embodiment, the height of the track system 308 relative to the screen mesh 132 is set at each corner of the frame system 302. In other embodiments, the height may be adjusted at only the front, the back, the sides, or another location on the frame system 302. Additionally, in this embodiment, the mounting system 332 mounts the MRS frame 306 to the screen frame 130 at each corner of the frame system 302. In other embodiments, the mounting system may be located only at the front, only at the back, only at the sides or one of the sides, or another location.

The height locking mechanism 330 locks in place the selected height of the track system 308 relative to the MRS frame 306 and screen frame 132. In this embodiment, a height locking mechanism 330 is located at each corner of the frame system 302. In other embodiments, a height locking mechanism may be located only at the front, the back, one or more of the sides, or other locations. In other embodiments, the height locking mechanism 330 is integrated with the height adjuster 328. In other embodiments, one or more height locking mechanisms 330 may be used.

The angle of the MRS squeegee 304 is selected by locating the angle locking pin 350 in one of the angle selector apertures 342. The angle selector apertures 342 may be located at specific angles, evenly spaced along a portion of the angle adjuster frame 354, or otherwise located.

The first set of guide members 344 on each side of the squeegee 304 are placed between the upper and lower tracks 312 and 314 of the left and right track frame 310. In this example, the blade angle (the angle of the squeegee blade 338 relative to the screen mesh 132) and the track height (the height between the track system 308 and the screen mesh 132) are selected to cause the blade 338 to bias against the screen mesh 132 when the guide members 344 and 346 are guided between the upper and lower tracks 312 and 314 in the application area 324. The degree of the biasing is the amount of downward pressure applied against the screen mesh 132 during the process and is proportional to the track height.

In one embodiment, because the screen mesh 132 is biasing against the blade 338 of the squeegee 304, it is difficult to locate the second set of guide members 346 in the application area 324. The flanged area 318 assists this process by self-guiding the second set of guide members 346 between the upper and lower tracks 312 and 314. Thus, the angle of the flanged area 314 directs the second guide members 346 between the upper and lower tracks 312 and 314 without requiring the user to press directly against the biasing action to locate the second guide members within the tracks. In some instances, the flanged area 318 also assists in guiding the first set of guide members 344 between the upper and lower tracks 312 and 314.

Once both guide members 344 and 346 are between the upper and lower tracks 312 and 314, the user pulls the squeegee 304 through the application area 324, thereby applying ink or another substance on the substrate. The first guide members 344 then will exit the track system 308 at the recessed area 322 of the exiting end 320.

In one embodiment, because the squeegee 304 is biasing against the screen mesh 132, the recessed area 322 enables the first guide members 344 on each side of the squeegee to be gently biased up and out of the track system 308. Thus, some of the biasing force is eliminated when the first guide members 344 exit the recessed area 322 of the exiting end 320. Similarly, the biasing force is eliminated when the second guide members 346 exit the recessed area 322 of the exiting end 320.

Figure 12:
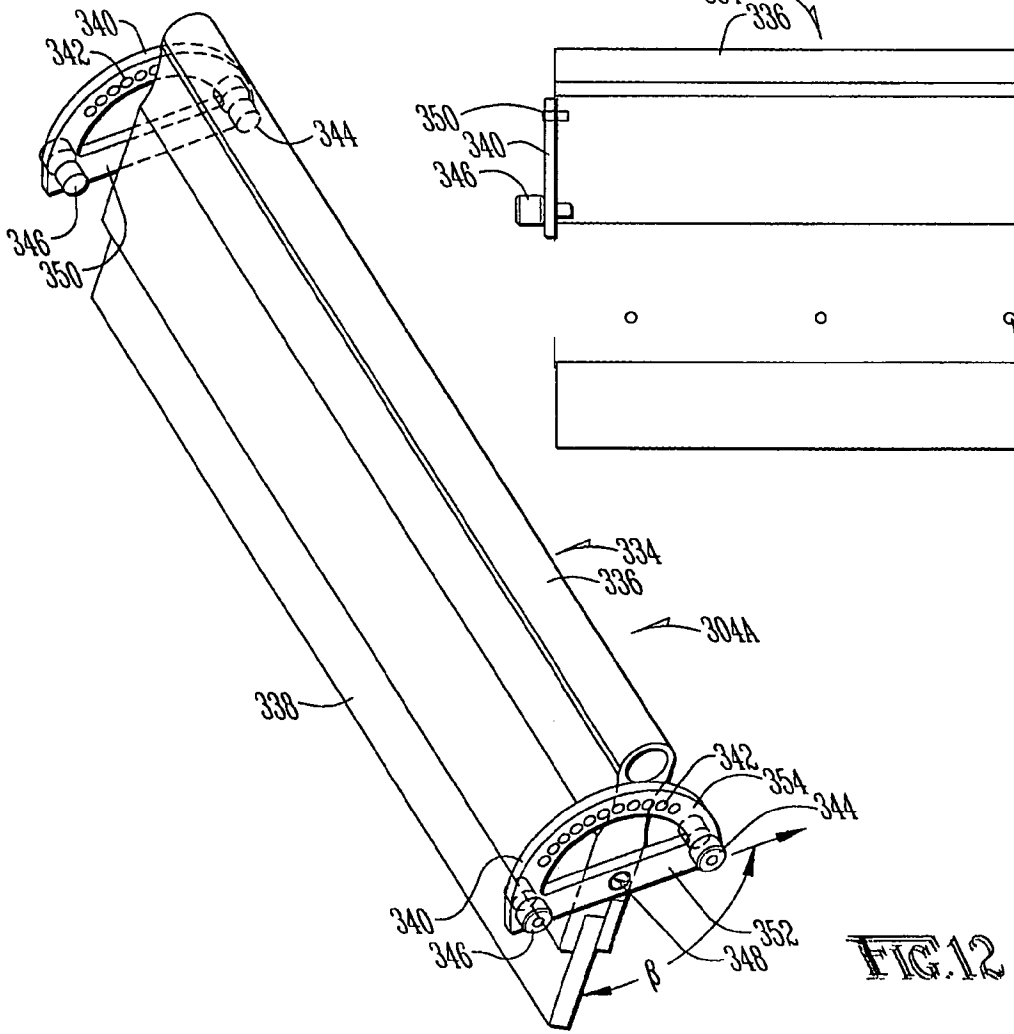
FIG. 12 is a perspective view of a squeegee having an angle adjuster and guide members in accordance with an embodiment of the present invention.
Figure 15:
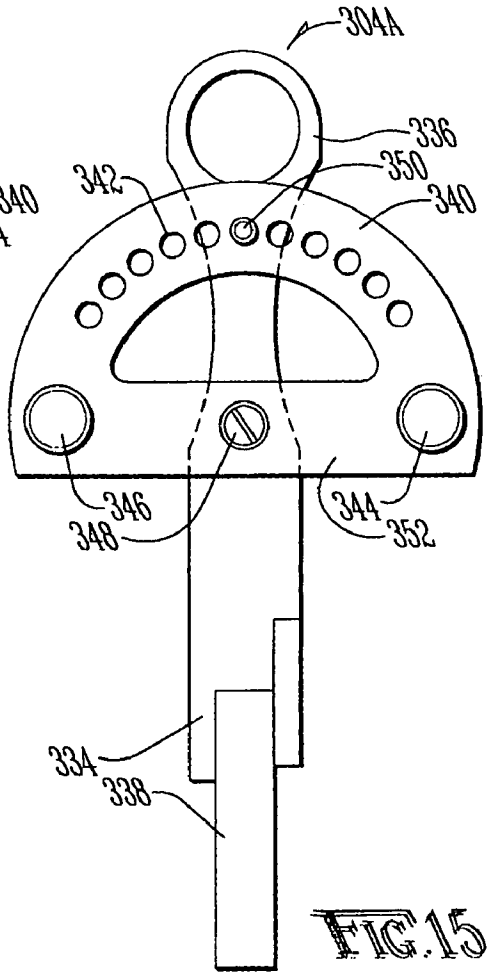
FIG. 15 is a side view of the squeegee of FIG. 13.
Figure 14:
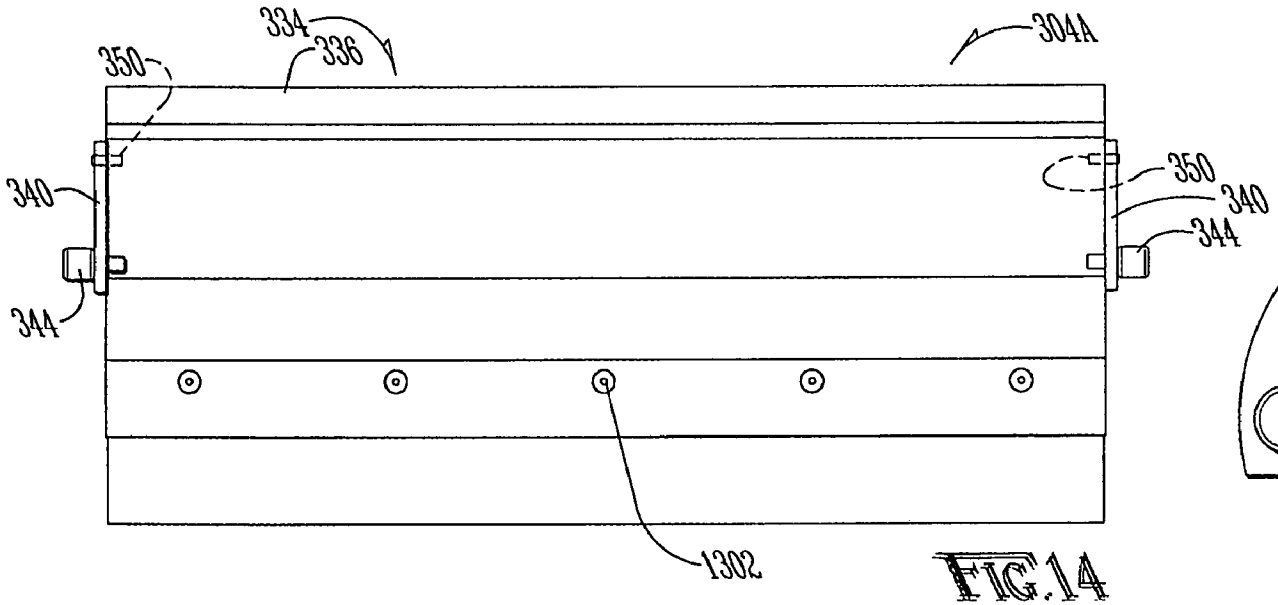
FIG. 14 is a bottom view of the squeegee of FIG. 13.

The blade angle (Beta) (see FIG. 12) is the angle between the plane 352 in which the guide member or guide members are traveling (the "guide plane") and the plane at which the blade 338 is set. Since the guide member or guide members typically travel in the track system 308 parallel to the screen mesh 132, the blade angle also is the angle between the screen mesh and the blade 338.

In one example, the guide members 344 and 346 travel through the track system 308 in a horizontal or near-horizontal plane. In this example, the track system 308 is parallel to the screen mesh 132. The blade 338 is fixed in the squeegee frame 334 relative to the plane 352 in which the guide members 344 and 346 are traveling, which is at least approximately parallel to the screen mesh 132. In this instance, the blade 338 is at an angle relative to the horizontal or near-horizontal plane. Therefore, the blade angle is the angle between the blade 338 and the screen mesh 132, and it is the same or approximately the same angle between the blade and the guide plane 352. In other embodiments, the guide member or guide members may travel in a different guide plane, such as a plane ten-degrees counter-clockwise from the horizontal.

The track height is the height of the track system 308 relative to the height of the MRS frame 306. Since the MRS frame 306 is mounted to the screen frame 130, and the screen mesh 132 is mounted within the screen frame, the track height also is the height of the track system 308 relative to the screen mesh 132. Since the guide member or guide members of the squeegee 304 travel in a guide plane through the track system 308, the selected track height causes the blade to be at a selected blade height when the guide member or members are traveling through the track system 308.

The height of the blade 338 is proportional to the amount of biasing force applied to the screen mesh 132. If the track height, and therefore the blade, is higher relative to the screen mesh 132, less biasing force is applied between the blade and the screen mesh. If the track height, and therefore the blade, is lower relative to the screen mesh 132, more biasing force is applied between the blade and the screen mesh. Therefore, by selecting the track height, and therefore the blade height, the user may select the biasing force applied between the blade 338 and the screen mesh 132.

Because a user can select a specific track height/blade height and a specific blade angle, the user can apply a consistent biasing force between the blade 338 and the screen mesh 132 and apply the biasing force at a consistent angle. Therefore, one or more inks may be applyed on one or more substrates in one or more runs by a single user or multiple users in a consistent manner. Moreover, a user does not have to guess what amount of pressure is a "medium" pressure or the actual angle being applied. Moreover, a track height and or a blade angle setting may be selected and specifically reproduced for future runs. One user can easily identify the settings for other users, including other users at different locations, with specificity.

FIG. 6 depicts an exemplary embodiment of an adjustment assembly 326A. In the embodiment of FIG. 6, the adjustment assembly 326A includes a height adjuster 328A, a height locking mechanism 330A, and a mounting system 332A. Other embodiments may include one or more of a height adjuster, a height locking mechanism, and a mounting system.

In the embodiment of FIG. 6, the adjustment assembly 326A also includes a bracket 602 having a first slot 604 and a second slot 606. In one embodiment, the bracket is mounted to the MRS frame 306.

While the bracket 602 is depicted in the corner of the MRS frame 306 in FIG. 6, the bracket may be located in another location. In one embodiment, the bracket 602 is located at each of the left and right sides of the MRS frame 306. In another embodiment, the bracket 602 is located at each of the front and back sides of the MRS frame 306. Other examples exist.

Other embodiments may not have a bracket 602. In one example, the height adjuster 328A is mounted to a portion of the MRS frame 306 and a bracket 602 does not exist.

The height adjuster 328A has a shaft 608, at least a portion of which is threaded, a first receiver 610 having an aperture through which the shaft extends, a second receiver 612 having a threaded aperture through which the threaded portion of the shaft is threaded, and an adjustment mechanism 614, such as a knob. The adjustment mechanism 614 may be fixedly attached to the shaft or formed as part of the shaft so that turning the adjustment mechanism will turn the shaft through the threaded aperture on the second receiver 612.

The first receiver 610 is mounted to, attached to, or formed as a part of, the bracket 602. The second receiver 612 is mounted to, attached to, or formed as a part of, the track frame 310 and extends through the first slot 604 of the bracket 602. In one embodiment, the threaded shaft 608 is threaded through the first receiver 610 and into the second receiver 612. Therefore, in this embodiment, the threaded shaft 608 supports the weight of the track frame 310 to the bracket 602. Additional strength is provided between the bracket 602 and the track system 310 since the threaded shaft 608 is threaded through both the first receiver 610 and the second receiver 612, and the threaded shaft is the connection between the bracket and the track system.

When the adjustment mechanism is turned, the threads on the shaft 608 turn through the threads in the aperture of the second receiver 612. This action causes the second receiver 612 to move vertically through the first slot 604, causing the track frame 310 to move vertically. The first slot 604 restricts the horizontal movement of the second receiver 612, thereby restricting the horizontal movement of the track frame 310.

In one embodiment, the height adjuster 328A also includes a shaft collar 616 that is fixedly attached to the shaft 608, such as with a hex bolt or another fastener. The shaft collar 616 operates to restrict the vertical distance that may be traveled by the center shaft 608. The shaft collar 616 contacts the first receiver 610 when the height is adjusted up, thereby limiting the vertical distance that may be traveled by the shaft. As a result, the shaft 608 is limited from extending vertically out of the second receiver 612.

In another embodiment, neither the first receiver 610 nor the shaft collar 616 are threaded. In this embodiment, the portion of the shaft 608 extending through the first receiver 610 also need not be threaded. The shaft 608 rotates freely within the aperture of the first receiver 610. The shaft collar restricts the vertical movement of the shaft 608 since both the adjustment mechanism 614 and the shaft collar are fixedly attached to the shaft around the first receiver 610.

The height adjuster 328A optionally may include a washer 618 between the adjustment mechanism 614 and the first receiver 610. The washer 618 provides a tight fit to resist loosening caused by vibration or to operate as a spacer.

The height locking mechanism 330A includes a lever 620 or other handle connected to a lever shaft 622. A portion of the lever shaft 622 is threaded and extends through the second slot 606 in the bracket 602 and into a threaded shaft receiver 624 on the track frame 310. The lever 620 also includes a bushing 626.

The lever shaft 622 moves vertically through the second slot 606 as the track frame 310 moves vertically since the shaft receiver 624 is fixed in or to the track frame. As the lever 620 is turned, the threads of the shaft 622 are screwed into the threaded shaft receiver 624, thereby compressing the bracket 602 between the bushing 626 and track frame 310.

The mounting system 332A has a center shaft 628 having a threaded portion 630 that extends through a shaft receiver 632 and another end having a clamp 634. An optional spring 636 fits over the threaded portion, and an adjustment mechanism 638 having interior threads screws onto the threaded portion 630 of the shaft 628. The spring 636 biases against the adjustment mechanism 638 forcing the adjustment mechanism 638 to move vertically. Since the threaded portion 630 of the shaft 628 is threaded into the interior of the adjustment mechanism, the whole shaft is biased vertically with the adjustment mechanism.

In one embodiment, a shaft collar (See FIG. 8) fits around the spring between the shaft receiver 632 and the adjustment mechanism 638. In another embodiment, a washer 640 is fitted between the spring 636 and the adjustment mechanism 638.

When the adjustment mechanism 638 is turned, the threaded portion 630 of the shaft 628 is screwed into the interior threads of the adjustment mechanism causing the shaft to move vertically, causing the clamp 634 to move vertically. The screen frame 130 is thereby tightened between the clamp 634 and the MRS frame 306.

In one embodiment, the shaft receiver 632 is mounted on, attached to, or formed as a composite part of, the bracket 602 or the MRS frame 306. In one embodiment, the aperture of the shaft receiver 632 is not threaded.

Figure 7:
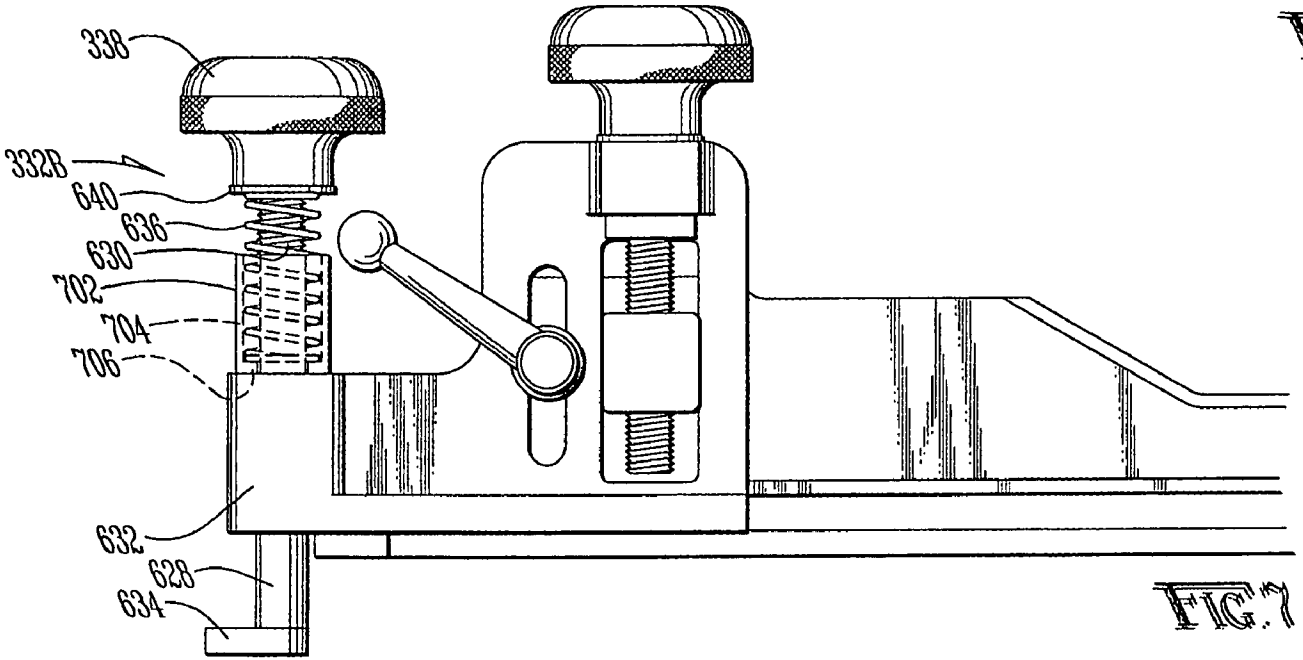
FIG. 7 is a side view of another adjustment assembly in accordance with an embodiment of the present invention.
Figure 8:
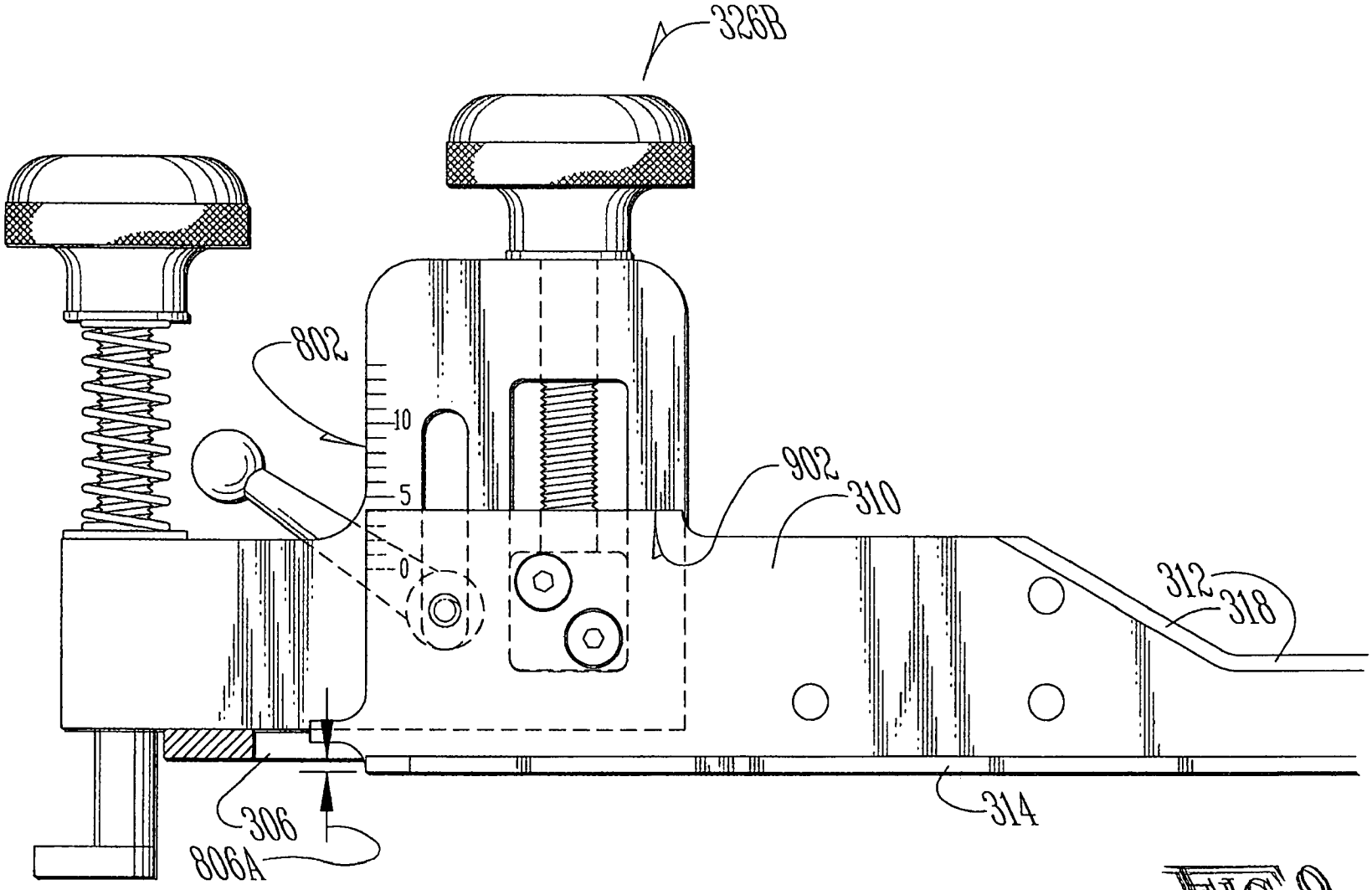

FIG. 7 depicts another embodiment of a mounting system 332B. In this embodiment, the mounting system 332B includes a shaft collar 702 having a recessed area 704 and a seat 706. The shaft 628 extends through an aperture in the collar 702 to the adjustment mechanism 638. The spring 636 fits within the recessed area 704 and sits on the seat 706. The washer 640 fits between the other end of the spring 636 and the adjustment mechanism 638.

Figure 8:
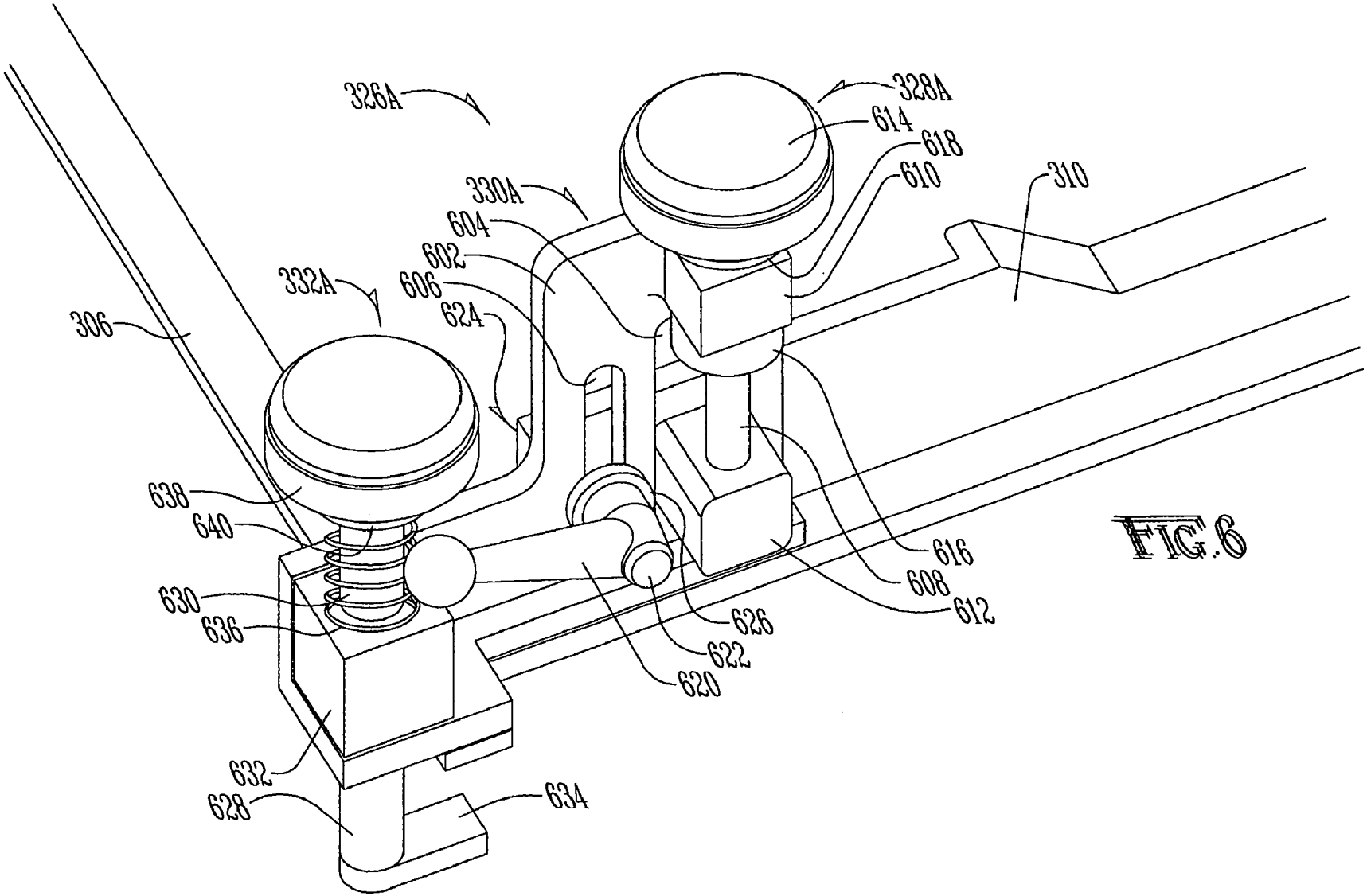
FIG. 8 is a side view of a manual repetition system in accordance with an embodiment of the present invention.
Figure 8:
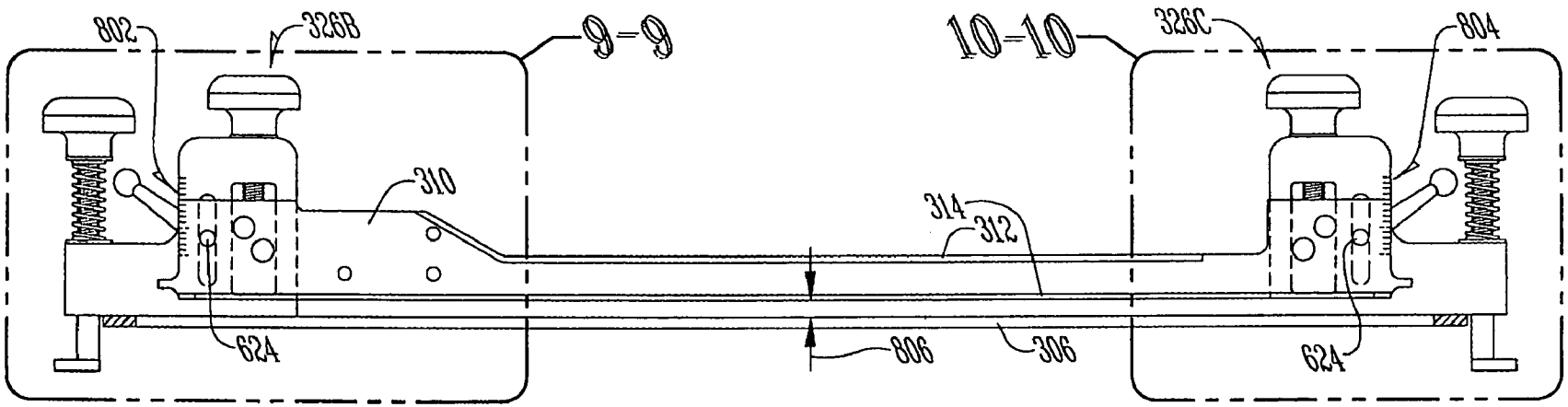

FIG. 8 depicts an inside view of the track frame 310 and the upper and lower tracks 312 and 314 relative to the bottom of the MRS frame 306. Each of the front and rear adjustment assemblies 326B and 326C include height identifier markings 802 and 804 used to set the track height 806 relative to the MRS frame 306. It will be appreciated that other types of height identifier markings may be used, and they may be located at different locations.

Figure 10:
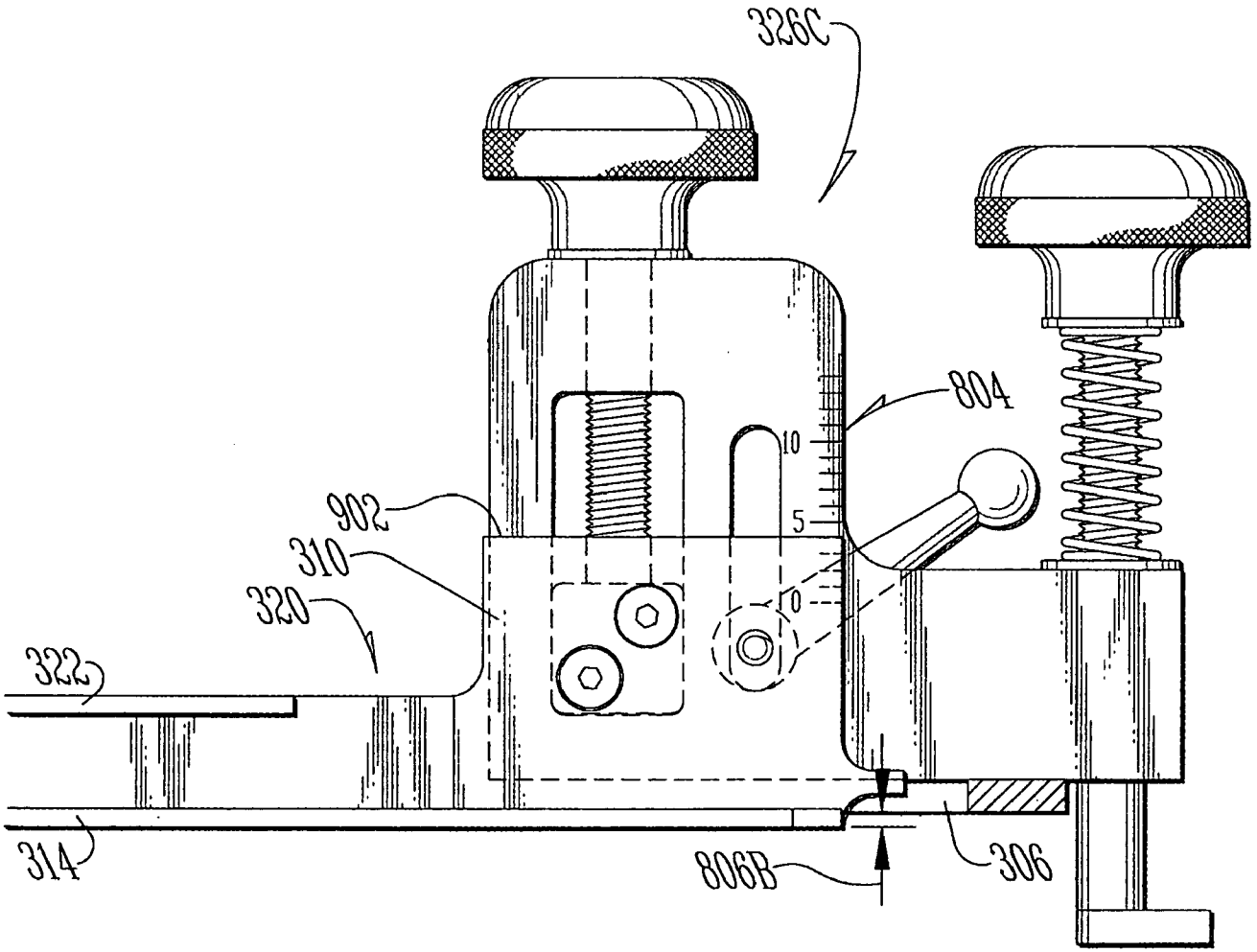
FIG. 10 is an inside view of an adjustment assembly and a track system having an exiting end at a first height in accordance with an embodiment of the present invention.
Figure 11:
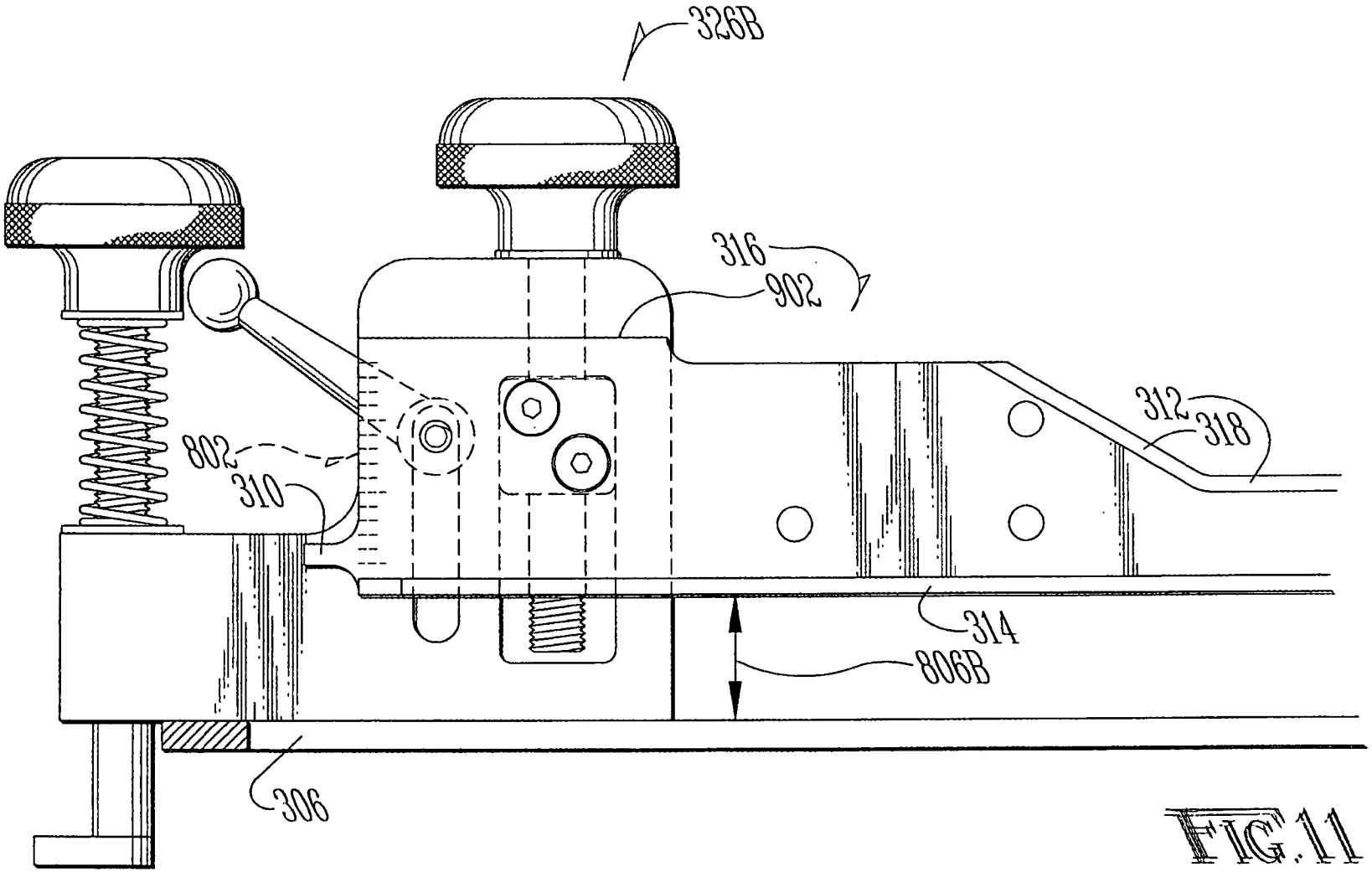
FIG. 11 is an inside view of an adjustment assembly and a track system having a receiving end at a second height in accordance with an embodiment of the present invention.
Figure 13:
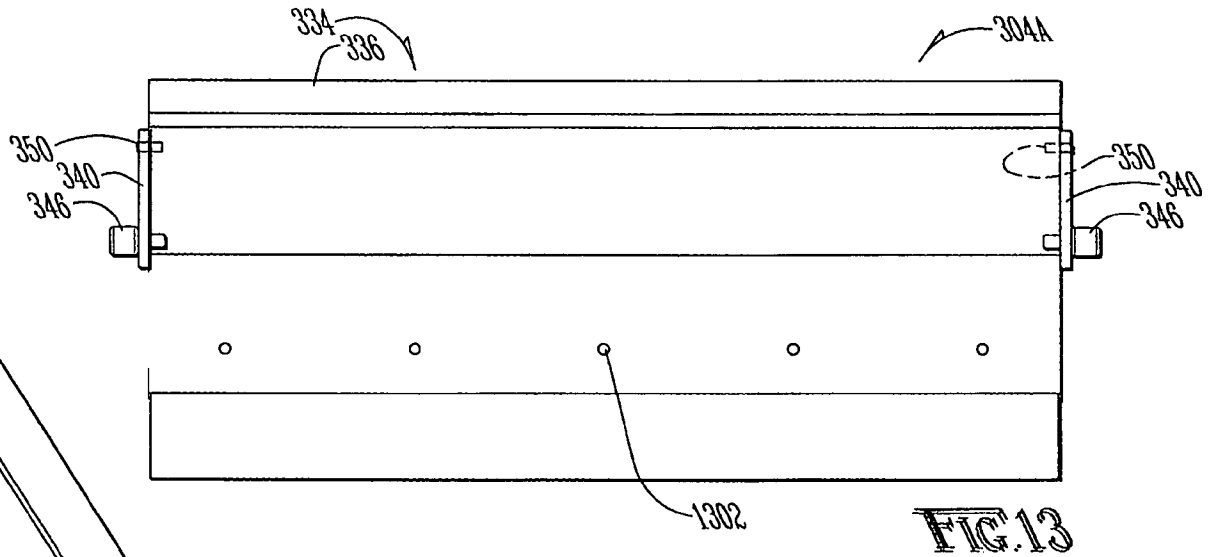
FIG. 13 is a top view of a squeegee having an angle adjuster, guide members, and an angle selection pin in accordance with an embodiment of the present invention.

FIGS. 9–11 show examples of the track height at different levels. FIG. 9 depicts the receiving end 316 at a first track height 806A. In this example, the top 902 of the track frame 310 is at the fourth setting of the height identifier markings 802.

FIG. 10 depicts an example of the exiting end 320 having the same track height 806A as the receiving end 316 depicted in FIG. 9. The top 902 of the track frame 310 is set at the fourth setting of the height identifier markings 804.

FIG. 11 depicts another example of the receiving area 316 at a second track height 806B. In this example, the top 902 of the track frame 316 is set at a fifteenth setting of the height identifier markings 802.

FIGS. 12–15 depict an exemplary embodiment of an MRS squeegee 304A. The squeegee 304A includes the same components as the squeegee 304 of FIG. 3. The squeegee 304A also includes blade fasteners 1302, such as hex bolts and bolt receivers, that removably fasten or otherwise attach the blade 338 on or in the squeegee frame 334. The blade fasteners 1302 may be removed so that another blade may be placed in the frame 334 or so that the blade may be flipped.

In one embodiment, the blade is made from rubber. In this embodiment, different rubber blades may have different durometer values.

In another embodiment, the fastener 348 is a detent fastener that is spring loaded. The detent fastener 348 enables a user to pull the angle adjuster 340 away from the frame 334, select an angle selector aperture 342, and place the selected angle selector aperture over the angle locking pin 350. In another embodiment, the fastener 348 is not spring loaded.

In another embodiment, the angle locking pin 350 is spring loaded. In this embodiment, a user may press the spring loaded angle locking pin 350 into the frame 334, select an angle selector aperture 342, and enable the spring loaded angle locking pin to spring out and lock into place.

In one embodiment, the angle adjuster 340 rotates about the fastener 348. The fastener 348 therefore is the axis point for the angle adjuster 340 on the squeegee frame 334.

In another embodiment, each angle adjuster 340 has a single guide member. In one example, the single guide member on each angle selector 340 is the axis point for the angle adjuster and also operates to fasten the angle adjuster to the squeegee frame 334.

In one embodiment, a first angle selector aperture 342 is aligned with the aperture in the angle adjuster frame 354 for the fastener 348. Four angle selector apertures are evenly spaced in a clockwise direction from the center angle selector aperture, and four angle selector apertures are evenly spaced in a counterclockwise direction from the center angle selector aperture. The user may select the second angle selector aperture in the clockwise direction from the center angle selector aperture for a first operation of the MRS 202. The user then may select the second aperture in the counterclockwise direction from the center angle selector aperture and flip the whole squeegee 304 horizontally for a second operation. The first and second settings provide the same result. Therefore, a user may use a first edge of the blade 338 at the first setting and a second edge of the blade at the second setting, thereby extending the blade life.

Those skilled in the art will appreciate that variations from the specific embodiments disclosed above are contemplated by the invention. The invention should not be restricted to the above embodiments, but should be measured by the following claims.

What is claimed is:

1. A system operable for manually printing with a squeegee and a screen comprising:

an MRS frame removably mountable to the screen;

a track system having a first and second track frame at opposing sides of the MRS frame, each with an open receiving end and an open exiting end and each configured with an upper track and a lower track, each upper track forming a flanged area at the receiving end, wherein the flanged area is configured to guide the squeegee between the upper track and the lower track of the opposing track frames at the receiving end of the track system; and a height adjustor mounted to the MRS frame and mounted to the track system and configured to adjust a height of the track system relative to the MRS frame for a selected height.

2. The system of claim 1 wherein each upper track further forms a recessed area at the exiting end, and the recessed area is configured to upwardly release the squeegee from the opposing track frames at the exiting end.

3. The system of claim 1 wherein the screen has a screen mesh and the squeegee comprises:

a squeegee frame;

a blade for the squeegee frame;

at least one angle adjustor configured to adjust a blade angle relative to a guide plane of the squeegee and to enable selection of a selected blade angle; and at least one guide member on opposing ends of the squeegee frame configured to travel between the upper track and the lower track of the opposing track frames in the guide plane between the receiving end and the exiting end;

wherein the blade is configured to travel at the selected blade angle and at the selected height when the at least one opposing guide members travel between the receiving end and the exiting end of the opposing track frames, the selected height and the selected blade angle resulting in a selected biasing force being applied by the blade.

4. The system of claim 3 wherein:

the at least one guide member on opposing ends of the squeegee frame comprises a plurality of guide members mounted to the at least one angle adjustor, each of the guide members configured to travel between the upper track and the lower track of at least one of the track frames between the receiving end and the exiting end; and the at least one angle adjustor is movably attached to at least one opposing end of the squeegee frame.

5. The system of claim 3 wherein:

the at least one angle adjustor comprises:

an angle adjustor frame comprising a plurality of angle selector apertures;

a fastener configured to movably fasten the angle adjustor frame to the squeegee frame; and an angle locking pin configured to lock at least one of the angle selector apertures at the selected blade angle with respect to the squeegee frame; and the at least one guide member on opposing ends of the squeegee frame comprises a plurality of guide members for the angle adjustor frame configured to travel between the upper track and the lower track of at least one of the track frames between the receiving end and the exiting end.

6. The system of claim 5 wherein:

the angle locking pin comprises a spring-loaded locking pin configured to retract into the squeegee frame and the fastener is configured to enable the angle adjustor frame to rotate for selection of the at least one of the angle selector apertures.

7. The system of claim 5 wherein the fastener comprises a spring loaded fastener configured to enable pulling the angle adjustor frame away from the squeegee frame and to enable rotating the angle adjustor frame for selection of the at least one of the angle selector apertures for the selected blade angle.

8. The system of claim 3 wherein the at least one guide member on opposing ends each comprise at least one member of a group consisting of a roller and a ball bearing.

9. The system of claim 3 wherein the blade is removably attached to the squeegee frame.

10. The system of claim 1 wherein the height adjustor comprises:

a first receiver mounted to the MRS frame;

a second receiver mounted to the track system;

a shaft having an axis and extending between the first receiver and the second receiver; and an adjustment mechanism configured to move the shaft to effect axial movement of the second receiver with respect to the first receiver along the shaft axis.

11. The system of claim 10 wherein:

the MRS frame comprises a bracket having a first aperture;

the first receiver comprises a second aperture;

the shaft comprises threads at approximately one end of the shaft and is configured, at one other end of the shaft, to fit through the second aperture and to attach to the adjustment mechanism;

the second receiver comprises other threads receivable by the shaft threads and is configured to mount at least partially through the aperture to the track system; and the adjustment mechanism is configured to rotate the shaft, thereby turning the shaft threads with respect to the second receiver threads to effect axial movement of the second receiver through the first aperture along the shaft axis and with respect to the first receiver.

12. The system of claim 1 further comprising height identifier markings configured to enable selecting the selected height of the track system relative to the MRS frame.

13. The system of claim 1 further comprising a height locking mechanism configured to lock the height of the track system relative to the MRS frame at the selected height.

14. The system of claim 13 wherein the MRS frame comprises a bracket having an aperture, the track system comprises a shaft receiver, and the height locking mechanism comprises:

a shaft configured to fit through the aperture and to be received at one end of the shaft by the shaft receiver of the track system;

a bushing approximately at another end of the shaft and configured larger than the aperture; and a lever approximately at the bushing end of the shaft and configured to enable turning the shaft to loosen or tighten the MRS frame between the bushing and the track system.

15. The system of claim 1 further comprising a mounting system configured to mount the MRS frame to the screen frame.

16. The system of claim 15 wherein the mounting system comprises:

a shaft receiver comprising an aperture and mounted to the MRS frame;

a shaft having an axis and configured to fit through the aperture of the shaft receiver at one end of the shaft;

a clamp on one other end of the shaft;

an adjustment mechanism configured to attach to the one end of the shaft and to move the shaft along the shaft axis to effect axial movement of the clamp with respect to the shaft receiver, thereby effecting movement of the clamp with respect to the MRS frame.

17. The system of claim 16 wherein:

the shaft comprises threads;

the shaft receiver comprises other threads receivable by the shaft threads; and the adjustment mechanism is configured to rotate the shaft, thereby turning the shaft threads with respect to the shaft receiver threads to effect axial movement of the shaft through the shaft receiver along the shaft axis.

18. The system of claim 17 wherein the clamp is configured to tighten and loosen the screen frame against the MRS frame as the shaft threads are turned with respect to the shaft receiver threads.

19. The system of claim 1 further comprising a manual printing press comprising at least one print head assembly configured to mount the screen frame to which the MRS frame is removably mountable.

20. The system of claim 19 wherein:

the manual printing press further comprises at least one pallet configured to support at least one substrate;

the at least one print head assembly further is configured to enable locating the screen in at least approximate contact to the at least one substrate; and the system is operable to enable applying the at least one substance through the screen to the at least one substrate.

21. The system of claim 20 wherein the manual printing press comprises a plurality of print head assemblies and a plurality of pallets.

22. A system operable for manually printing with a screen having a screen frame comprising:

an MRS frame removably mountable with the screen frame;

a track system having a first and second track frame at opposing sides of the MRS frame, each with an open receiving end and an open exiting end and each configured with an upper track and a lower track, the upper track forming a flanged area at the receiving end; and a height adjustor configured to adjust a height of the track system relative to the MRS frame to a selected height.

23. The system of claim 22 wherein each upper track further forms a recessed area at the exiting end, and the recessed area is configured to upwardly release the squeegee from the opposing track frames at the exiting end.

24. The system of claim 22 wherein the system further is operable with a squeegee having a frame and at least one guide member on opposing ends of the squeegee frame, and wherein the flanged area is configured to guide the at least one opposing guide members between the upper track and the lower track of the opposing track frames at the receiving end of the track system.

25. The system of claim 22 wherein the screen has a screen mesh and the system further comprises a squeegee comprising:

a squeegee frame;

at least one guide member on opposing ends of the squeegee frame;

a blade for the squeegee frame; and at least one angle adjustor configured to adjust an angle of the blade relative to a guide plane of the squeegee and to enable selection of a selected blade angle of the squeegee for the guide plane; and wherein the at least one guide member on opposing ends of the squeegee frame is configured to travel between the upper track and the lower track of the opposing track frames in the guide plane between the receiving end and the exiting end; and wherein the blade is configured to apply the substance through the screen mesh at the height and the selected blade angle when the at least one opposing guide members travel along the guide plane between the receiving end and the exiting end of the opposing track frames, the height resulting in a selected biasing force being applied between the blade and the screen mesh.

26. The system of claim 25 wherein:

the at least one angle adjustor comprises:

an angle adjustor frame comprising a plurality of angle selector apertures; and a plurality of guide members for the angle adjustor frame configured to travel between the upper track and the lower track of at least one of the track frames between the receiving end and the exiting end; and the squeegee further comprises:

a fastener configured to movably fasten the angle adjustor frame to the squeegee frame; and an angle locking pin configured to lock at least one of the angle selector apertures at the selected blade angle.

27. The system of claim 22 wherein the height adjustor comprises:

a first receiver mounted to the MRS frame;

a second receiver mounted to the track system;

a shaft having an axis and extending between the first receiver and the second receiver; and an adjustment mechanism configured to move the shaft to effect axial movement of the second receiver with respect to the first receiver along the shaft axis.

28. The system of claim 27 wherein:

the MRS frame comprises a bracket having a first aperture;

the first receiver comprises a second aperture;

the shaft comprises threads at approximately one end of the shaft and is configured, at one other end of the shaft, to fit through the second aperture and to attach to the adjustment mechanism;

the second receiver comprises other threads receivable by the shaft threads and is configured to mount at least partially through the aperture to the track system; and the adjustment mechanism is configured to rotate the shaft, thereby turning the shaft threads with respect to the second receiver threads to effect axial movement of the second receiver through the first aperture along the shaft axis and with respect to the first receiver.

29. The system of claim 22 further comprising a height locking mechanism configured to lock the height of the track system relative to the MRS frame at the selected height.

30. The system of claim 29 wherein the MRS frame comprises a bracket having an aperture, the track system comprises a shaft receiver, and the height locking mechanism comprises:

a shaft configured to fit through the aperture and to be received at one end of the shaft by the shaft receiver of the track system;

a bushing approximately at another end of the shaft and configured larger than the aperture; and a lever approximately at the bushing end of the shaft and configured to enable turning the shaft to loosen or tighten the MRS frame between the bushing and the track system.

31. The system of claim 22 further comprising a mounting system configured to mount the MRS frame to the screen frame.

32. The system of claim 31 wherein the mounting system comprises:

a shaft receiver comprising an aperture and mounted to the MRS frame;

a shaft having an axis and configured to fit through the aperture of the shaft receiver at one end of the shaft;

a clamp on one other end of the shaft;

an adjustment mechanism configured to attach to the one end of the shaft and to move the shaft along the shaft axis to effect axial movement of the clamp with respect to the shaft receiver, thereby effecting movement of the clamp with respect to the MRS frame.

33. The system of claim 32 wherein:

the shaft comprises threads;

the shaft receiver comprises other threads receivable by the shaft threads; and the adjustment mechanism is configured to rotate the shaft, thereby turning the shaft threads with respect to the shaft receiver threads to effect axial movement of the shaft through the shaft receiver along the shaft axis;

wherein the clamp is configured to tighten and loosen the screen frame against the MRS frame as the shaft threads are turned with respect to the shaft receiver threads to effect axial movement of the shaft through the shaft receiver along the shaft axis.

34. The system of claim 22 further comprising a manual printing press comprising at least one print head assembly configured to mount the screen frame to which the MRS frame is removably mountable.

35. A method operable for providing for manual printing with a squeegee and a screen comprising:

providing an MRS frame to removably mount to the screen;

providing a track system having a first and second track frame at opposing sides of the MRS frame, each with an open receiving end and an open exiting end and each configured with an upper track and a lower track, each upper track forming a flanged area at the receiving end, the flanged area configured to guide the squeegee between the upper track and the lower track of the opposing track frames at the receiving end of the track system; and mounting a height adjustor to the MRS frame and to the track system, the height adjustor configured to adjust a height of the track system relative to the MRS frame for a selected height.

36. The method of claim 35 further comprising providing each upper track with a recessed area at the exiting end, the recessed area configured to upwardly release the squeegee from the opposing track frames at the exiting end.

37. The method of claim 35 wherein the screen has a screen mesh, the method further comprising configuring a squeegee comprising:

providing a squeegee frame;

providing a blade for the squeegee frame;

providing at least one guide member on opposing ends of the squeegee frame configured to travel between the upper track and the lower track of the opposing track frames in the guide plane between the receiving end and the exiting end;

providing at least one angle adjustor configured to adjust an angle of the blade relative to a guide plane of the squeegee and to enable selection of a selected blade angle of the squeegee for the guide plane, the blade being operable to apply the substance through the screen mesh at the height and the selected blade angle when the at least one opposing guide members travel along the guide plane between the receiving end and the exiting end of the opposing track frames, the height resulting in a selected biasing force being applied between the blade and the screen mesh.

38. The method of claim 37 wherein providing the at least one guide member on opposing ends of the squeegee frame comprises providing a plurality of guide members mounted to the at least one angle adjustor, each of the guide members configured to travel between the upper track and the lower track of at least one of the track frames between the receiving end and the exiting end, the at least one angle adjustor movably attached to at least one opposing end of the squeegee frame.

39. The method of claim 37 wherein:

providing the at least one angle adjustor comprises:

providing an angle adjustor frame comprising a plurality of angle selector apertures; and providing a plurality of guide members for the angle adjustor frame configured to travel between the upper track and the lower track of at least one of the track frames between the receiving end and the exiting end; and providing the squeegee further comprises:

providing a fastener configured to movably fasten the angle adjustor frame to the squeegee frame; and providing an angle locking pin configured to lock at least one of the angle selector apertures at the selected blade angle.

40. The method of claim 39 wherein:

providing the angle locking pin comprises providing a spring-loaded locking pin configured to retract into the squeegee frame; and providing the fastener comprises enabling the angle adjustor frame to rotate for selection of the at least one of the angle selector apertures.

41. The method of claim 39 wherein providing the fastener comprises providing a spring loaded fastener configured to enable pulling the angle adjustor frame away from the squeegee frame and to enable rotating the angle adjustor frame for selection of the at least one of the angle selector apertures for the selected blade angle.

42. The method of claim 37 wherein providing the at least one guide member on opposing ends comprises providing at least one member of a group consisting of a roller and a ball bearing.

43. The method of claim 37 wherein providing the blade for the squeegee frame comprises removably attaching the blade to the squeegee frame.

44. The method of claim 35 wherein providing the height adjustor comprises:

mounting a first receiver to the MRS frame;

mounting a second receiver to the track system;

providing a shaft having an axis and extending between the first receiver and the second receiver; and providing an adjustment mechanism configured to move the shaft to effect axial movement of the second receiver with respect to the first receiver along the shaft axis.

45. The method of claim 44 wherein providing the MRS frame comprises providing a bracket having a first aperture, and the method further comprises:

providing the first receiver with a second aperture;

providing the shaft with threads at approximately one end of the shaft and to fit through the second aperture and to attach to the adjustment mechanism at one other end of the shaft;

providing the second receiver with other threads receivable by the shaft threads and to mount at least partially through the aperture to the track system; and providing the adjustment mechanism configured to rotate the shaft, thereby turning the shaft threads with respect to the second receiver threads to effect axial movement of the second receiver through the first aperture along the shaft axis and with respect to the first receiver.

46. The method of claim 35 further comprising providing height identifier markings configured to enable selecting the selected height of the track system relative to the MRS frame.

47. The method of claim 35 further comprising providing a height locking mechanism configured to lock the height of the track system relative to the MRS frame at the selected height.

48. The system of claim 47 wherein providing the MRS frame comprises providing a bracket having an aperture, providing the track system comprises providing a shaft receiver in the track system, and providing the height locking mechanism comprises:

providing a shaft configured to fit through the aperture and to be received at one end of the shaft by the shaft receiver of the track system;

providing a bushing approximately at another end of the shaft and configured larger than the aperture; and providing a lever approximately at the bushing end of the shaft and configured to enable turning the shaft to loosen or tighten the MRS frame between the bushing and the track system.

49. The method of claim 35 further comprising providing a mounting system configured to mount the MRS frame to the screen frame.

50. The method of claim 49 wherein providing the mounting system comprises:

providing a shaft receiver having an aperture and mounting the shaft receiver to the MRS frame;

providing a shaft having an axis and configured to fit through the aperture of the shaft receiver at one end of the shaft;

providing a clamp on one other end of the shaft;

providing an adjustment mechanism configured to attach to the one end of the shaft and to move the shaft along the shaft axis to effect axial movement of the clamp with respect to the shaft receiver, thereby effecting movement of the clamp with respect to the MRS frame.

51. The method of claim 50 further comprising:

providing the shaft with threads;

providing the shaft receiver with other threads receivable by the shaft threads; and providing the adjustment mechanism to be configured to rotate the shaft, thereby turning the shaft threads with respect to the shaft receiver threads to effect axial movement of the shaft through the shaft receiver along the shaft axis.

52. The method of claim 51 further comprising providing the clamp configured to tighten and loosen the screen frame against the MRS frame as the shaft threads are turned with respect to the shaft receiver threads to effect axial movement of the shaft through the shaft receiver along the shaft axis.

53. The method of claim 35 further comprising providing a manual printing press comprising at least one print head assembly configured to mount the screen frame to which the MRS frame is removably mountable.

54. The method of claim 53 wherein:

providing the manual printing press further comprises providing at least one pallet configured to support at least one substrate;

providing the at least one print head assembly further comprises providing the at least one print head assembly configured to enable locating the screen in at least approximate contact to the at least one substrate; and providing the system to enable applying the at least one substance through the screen to the at least one substrate.

55. The method of claim 54 wherein providing the manual printing press comprises providing a plurality of print head assemblies and a plurality of pallets.

56. A method operable for providing for manual printing with a screen having a screen frame comprising:

providing an MRS frame to removably mount to the screen frame;

providing a track system having a first and second track frame at opposing sides of the MRS frame, each with an open receiving end and an open exiting end and each configured with an upper track and a lower track, the upper track forming a flanged area at the receiving end; and providing a height adjustor to adjust a height of the track system relative to the MRS frame to a selected height.

57. The method of claim 56 further comprising providing each upper track with a recessed area at the exiting end, the recessed area configured to upwardly release the squeegee from the opposing track frames at the exiting end.

58. The method of claim 56 wherein the method further is operable with a squeegee having a frame and at least one guide member on opposing ends of the squeegee frame, and the method further comprises providing the flanged area to guide the at least one opposing guide members between the upper track and the lower track of the opposing track frames at the receiving end of the track system.

59. The method of claim 56 wherein the screen has a screen mesh, the method further comprising configuring a squeegee comprising:

providing a squeegee frame;

providing a blade for the squeegee frame;

providing at least one guide member on opposing ends of the squeegee frame configured to travel between the upper track and the lower track of the opposing track frames in the guide plane between the receiving end and the exiting end;

providing at least one angle adjustor configured to adjust an angle of the blade relative to a guide plane of the squeegee and to enable selection of a selected blade angle of the squeegee for the guide plane, the blade being operable to apply the substance through the screen mesh at the height and the selected blade angle when the at least one opposing guide members travel along the guide plane between the receiving end and the exiting end of the opposing track frames, the height resulting in a selected biasing force being applied between the blade and the screen mesh.

60. The method of claim 59 wherein:

providing the at least one angle adjustor comprises:

providing an angle adjustor frame comprising a plurality of angle selector apertures; and providing a plurality of guide members for the angle adjustor frame configured to travel between the upper track and the lower track of at least one of the track frames between the receiving end and the exiting end; and providing the squeegee further comprises:

providing a fastener configured to movably fasten the angle adjustor frame to the squeegee frame; and providing an angle locking pin configured to lock at least one of the angle selector apertures at the selected blade angle.

61. The method of claim 56 wherein providing the height adjustor comprises:

mounting a first receiver to the MRS frame;

mounting a second receiver to the track system;

providing a shaft having an axis and extending between the first receiver and the second receiver; and providing an adjustment mechanism configured to move the shaft to effect axial movement of the second receiver with respect to the first receiver along the shaft axis.

62. The method of claim 61 wherein providing the MRS frame comprises providing a bracket having a first aperture, and the method further comprises:

providing the first receiver with a second aperture;

providing the shaft with threads at approximately one end of the shaft and to fit through the second aperture and to attach to the adjustment mechanism at one other end of the shaft;

providing the second receiver with other threads receivable by the shaft threads and to mount at least partially through the aperture to the track system; and providing the adjustment mechanism configured to rotate the shaft, thereby turning the shaft threads with respect to the second receiver threads to effect axial movement of the second receiver through the first aperture along the shaft axis and with respect to the first receiver.

63. The method of claim 56 further comprising providing a height locking mechanism configured to lock the height of the track system relative to the MRS frame at the selected height.

64. The system of claim 63 wherein providing the MRS frame comprises providing a bracket having an aperture, providing the track system comprises providing a shaft receiver in the track system, and providing the height locking mechanism comprises:

providing a shaft configured to fit through the aperture and to be received at one end of the shaft by the shaft receiver of the track system;

providing a bushing approximately at another end of the shaft and configured larger than the aperture; and providing a lever approximately at the bushing end of the shaft and configured to enable turning the shaft to loosen or tighten the MRS frame between the bushing and the track system.

65. The method of claim 56 further comprising providing a mounting system configured to mount the MRS frame to the screen frame.

66. The method of claim 65 wherein providing the mounting system comprises:

providing a shaft receiver having an aperture and mounting the shaft receiver to the MRS frame;

providing a shaft having an axis and configured to fit through the aperture of the shaft receiver at one end of the shaft;

providing a clamp on one other end of the shaft;

providing an adjustment mechanism configured to attach to the one end of the shaft and to move the shaft along the shaft axis to effect axial movement of the clamp with respect to the shaft receiver, thereby effecting movement of the clamp with respect to the MRS frame.

67. The method of claim 66 further comprising:

providing the shaft with threads;

providing the shaft receiver with other threads receivable by the shaft threads; and providing the adjustment mechanism to be configured to rotate the shaft, thereby turning the shaft threads with respect to the shaft receiver threads to effect axial movement of the shaft through the shaft receiver along the shaft axis, the clamp configured to tighten and loosen the screen frame against the MRS frame as the shaft threads are turned with respect to the shaft receiver threads to effect axial movement of the shaft through the shaft receiver along the shaft axis.

68. The method of claim 56 further comprising providing a manual printing press comprising at least one print head assembly configured to mount the screen frame to which the MRS frame is removably mountable.

* * * * *